United States Patent [19]

Morrish et al.

[11] Patent Number: 4,726,970

[45] Date of Patent: Feb. 23, 1988

[54] PACKAGING EMPLOYING COMPUTER PAPER

[76] Inventors: Stephen C. Morrish; Diana L. Morrish, both of 1800 Nelson Unit 189, West Covina, Calif. 91792

[21] Appl. No.: 898,059

[22] Filed: Aug. 19, 1986

[51] Int. Cl.[4] ..... B65D 65/30

[52] U.S. Cl. ..... 428/35; 428/43; 428/137; 428/194; 282/11.5 R; 282/11.5 A; 383/37; 206/820

[58] Field of Search ..... 428/137, 201, 203, 194, 428/43, 35; 282/11.5 R, 11.5 A; 206/390, 484, 820; 383/37

[56] References Cited

U.S. PATENT DOCUMENTS

| | | | |
|---|---|---|---|
| 3,140,799 | 9/1963 | Steidinger | 229/69 |
| 3,339,827 | 9/1957 | Steidinger | 229/69 |
| 3,554,438 | 1/1971 | Malderghem | 229/69 |
| 3,877,728 | 4/1975 | Herz | 282/11.5 |
| 3,884,412 | 5/1975 | Price | 229/69 |
| 4,199,630 | 4/1980 | Consiglio | 428/43 |
| 4,344,557 | 8/1982 | Lerner | 206/820 X |
| 4,401,213 | 8/1983 | Lerner | 206/390 X |
| 4,508,224 | 4/1985 | Weber et al. | 206/455 |
| 4,543,279 | 9/1985 | Kai | 206/820 X |

*Primary Examiner*—Alexander S. Thomas
*Attorney, Agent, or Firm*—William W. Haefliger

[57] ABSTRACT

A packaging assembly adapted for labeling includes:

(a) a computer printout sheet having through holes in two parallel rows, (b) a flexible plastic sheet extending flatly adjacent one side of the printout sheet and locally bonded to the printout sheet along elongated bond zones extending at least partly about at least one pocket zone located between said two rows of holes.

The printout sheet may comprise a paper sheet and a plastic film attached to the paper sheet and in turn heat bonded to the plastic sheet. The composite assembly is typically perforated along lines to enable separation of the pockets or bags; and prior to such separation the paper sides of the bags may be labeled.

1 Claim, 8 Drawing Figures

PACKAGING EMPLOYING COMPUTER PAPER

BACKGROUND OF THE INVENTION

This invention relates generally to package production, and more particularly to multiple packages formed by bonding sheets together, and capable of automated printed labeling and package separation, with many resultant advantages, as will be seen.

There is continual need for rapid production of packages of sheet type, as well as need for automatic custom labeling of packages. Such needs have not been met in the unusually advantageous manner as now afforded by the present invention.

SUMMARY OF THE INVENTION

It is a major object of the invention to provide a multiple package composite capable of printout labeling, as by a computer driven printer, the bags then being separable for filling, sealing and shipping. Basically, the packaging composite or assembly in accordance with the invention comprises (a) a computer printout sheet having through holes in two parallel rows, (b) a flexible plastic sheet extending flatly adjacent one side of the printout sheet and locally bonded to the printout sheet along elongated bond zones extending at least partly about at least one pocket zone located between said two rows of holes.

As will be seen, the printout sheet typically includes two removable edge strips in which the two rows of holes are formed, the plastic sheet also bonded to the removable edge strips; and there may be two parallel tear lines via which the edge strips are attached to main extent of the printout sheet, the plastic sheet bonded to the printout sheet adjacent each tear line and at opposite sides thereof. Also pocket zones are formed between the rows of holes, the plastic sheet having multiple free edges respectively associated with said pockets, the free edges being free of attachment to the printout sheet to provide access to the pockets interiors between the free edges and the printout sheet.

It is another object of the invention to provide a printout sheet comprising a paper sheet and a polyethylene film integrally attached to the paper sheet and exposed at one side thereof, the plastic sheet consisting of polyethylene and being heat bonded to the film at said bond zones.

Yet another object is the provision of pockets which are rectangular, the bond zones extending as elongated bands along three edges of each pocket zone; and the bond zones may be formed as heat seals of the plastic sheet to the printout sheet, certain heat seals extending parallel to said rows of holes, and other heat seals extending generally perpendicular to said rows of holes. Successive groups of pockets are typiclaly spaced longitudinally lengthwise along said sheets, in the direction of said rows of holes, each group including at least two pockets spaced laterally between said rows of holes; and tear lines may be formed between successive pockets, laterally or longitudinally, the bond zones extending at opposite sides of the tear lines, the latter formed by rows of perforations. Free edges of the pockets may be formed by "Kiss cutting" of the plastic sheet, as will appear.

These and other objects and advantages of the invention, as well as the details of an illustrative embodiment, will be more fully understood from the following specification and drawings, in which:

DRAWING DESCRIPTION

DETAILED DESCRIPTION

Figure 1:
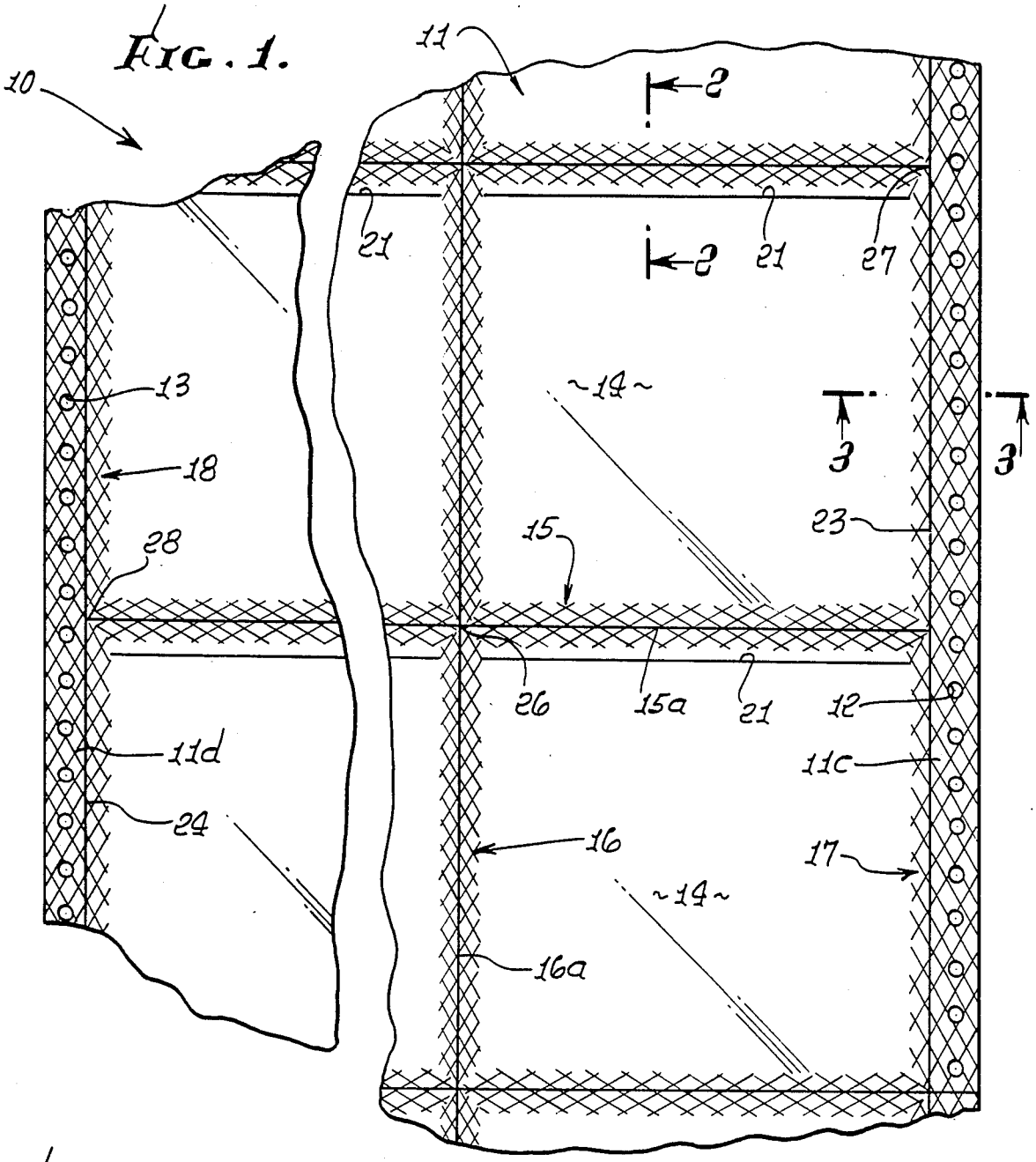
FIG. 1 is a frontal view of a composite, embodying the invention.

In the drawings, the packaging assembly 10 adapted for labeling includes a computer printout sheet 11 having through holes in two parallel rows, indicated by row of holes 12 and row of holes 13. A flexible plastic sheet 14 which may be transparent extends flatly adjacent one side of the printout sheet, and is locally bonded to the latter along elongated bond zones extending at least partly about at least one pocket zone located between the two rows of holes. Examples of the elongated bond zones are those extending horizontally at 15, those extending vertically at 16, and those extending vertically at 17 and 18. Pocket zones 20 are formed between the bond zones and have opposite walls defined by sheets 11 and 14, entrances to the pockets located beneath free edges 21 of the sheet 14 near zones 15.

More specifically, the printout sheet may advantageously comprise Kraft paper **11*a* and a thin polyethylene film 11*b* integrally attached to the paper sheet (as in "butcher" paper) and exposed at one side of the paper sheet. See FIGS. 2 and 3**.

Figure 3:
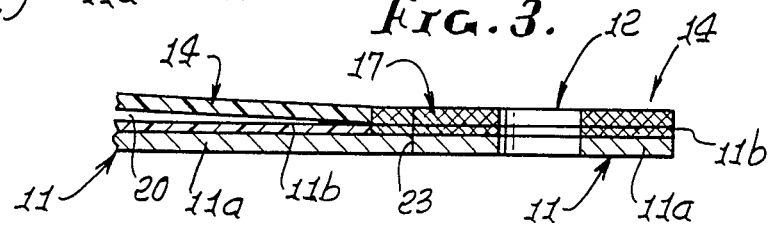
FIG. 3 is an enlarged section taken on lines 3—3 of FIG. 1.

More specifically the printout sheet 11 includes two removable edge strips **11*c* and 11*d* in which the two rows of through holes 12 and 13 are formed, the plastic sheet 14 bonded to the printout sheet at those locations, as is clear from FIG. 3. Removability of the edge strips is afforded by the two parallel tear lines 23 and 24 via which the edge strips are attached to the main extent of the printout sheet, the plastic sheet bonded (as by heating of thermoplastic) as at 17 to the printout sheet adjacent each tear line and at opposite sides thereof Such tear lines are typically formed by perforating at spaced locations along such lines, the perforations formed through the composite after heat bonding being seen in FIGS. 1 and 3. In similar manner, vertical and horizontal tear lines (as formed by perforations) are formed as at 15*a* and 16*a* along the band locations 15 and 16, and to intersect as at 26, 27 and 28. Accordingly, the resultant rectangular or squares can be torn apart along the tear lines to provide individual bags heat sealed along three sides, and open at their fourth sides, i.e. beneath free edges 21**.

The bond zones are typically formed as heat seals of a polyethylene second sheet 14 to the polyethylene film **11*b* integrally attached to Kraft paper 11*a*. Heat seals or bands 16 extend parallel to bands 17; and bands 15 extend perpendicular to bands 16, 17 and 18. Note heat sealing at 17 and 18 extends over the edge strips 11*c* and 11*d*, and that the holes 12 and 13 extend through the heat seals, including layers 11***a*, 11*b* and 14. (See FIG. 3). Alternately, the edge strips 11*c* and 11*d* may be free of heat sealing.

In the above manner, successive groups of pockets 20 are spaced lengthwise or longitudinally of the printout sheet, and two or more pockets may be located laterally of the printout sheet.

Figure 4:
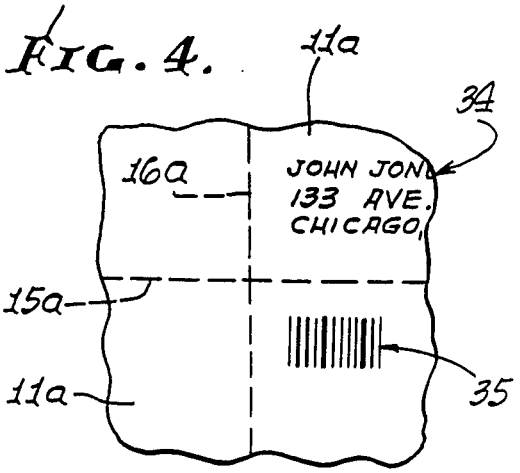
FIG. 4 is a fragmentary view of the reverse side of the FIG. 1 composite, showing labeling on the paper sides of multiple pocket zones.
Figure 5:
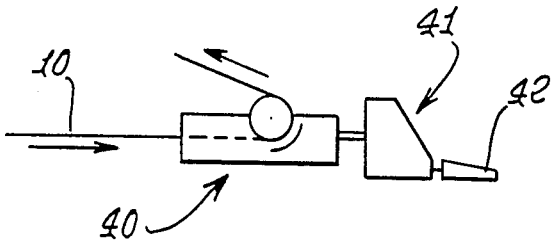
FIG. 5 is a diagrammatic view of a computer driven printer printing labels on the composite sheet of the invention.
Figure 6:
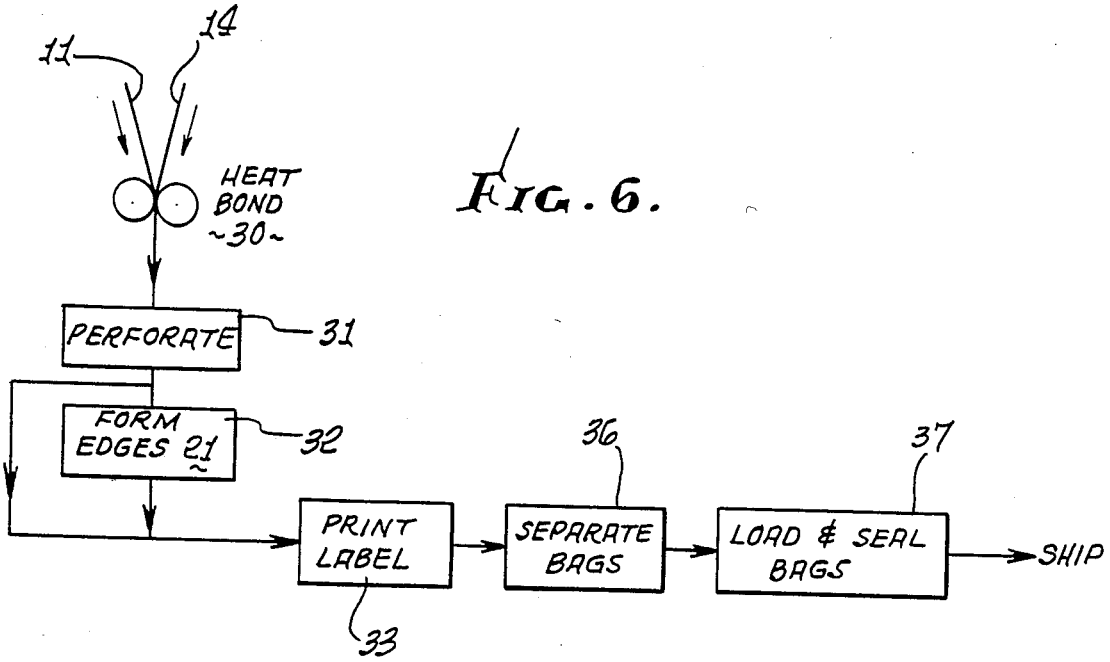
FIG. 6 is a process flow diagram.

FIG. 6 shows a process flow diagram, with sheets 11 and 14 fed to a heat bonding stage at 30, after which the composite is perforated at 31. Next, the edges 21 are formed at 32 as by "Kiss cutting" (i.e. cutting sheet 14 without cutting sheet 11). Print labeling is accomplished at stage 33, and FIG. 5 shows a computer printer automatically applying labels. Typical labels are shown by name and address printing at 34 on paper 11*a*, or bar code printing at 35, in FIG. 4. The bags are then separated at 36, loaded and heat sealed at 37, and shipped, as indicated in FIG. 6. A printer 40, driven by computer 41 with keyboard 42, is shown in FIG. 5.

Bags can be supplied in various sizes, widths, depths, and thicknesses of material. Product can be supplied in a fanfold or roll form and printed with custom information, and ¼ color for visual needs. Other poly material can be substituted to create anti-static bags, autoclavable bags, bags conforming to multiple specifications, and other specific commercial needs.

Advantages include cost reductions over conventional poly material bags, labeling and tracking system; reduction in number of components to assemble; no separate label application requirement; reduced material handling labor; improved inventory analysis, error reduction and improved traceability; capability for use with different type heat sealers; full widths slit for easy product insertion; capability for product shipment without additional containers; parts visibility on one side of bag, and full printable area on opposite side of bag.

The sheet 11*a* is preferably between #40 to #90 pound Kraft paper; and film 11*b* is between 0.001 to 0.005 inches in thickness. Sheet 14 is between 0.001 and 0.005 inches thick.

It will be understood that the invention is applicable to sheets such as at 14 and 11, but without edge strips 11*c* and 11*d*; i.e. lines 23 and 24 in such cases representing the edges of the sheets.

Figure 7:
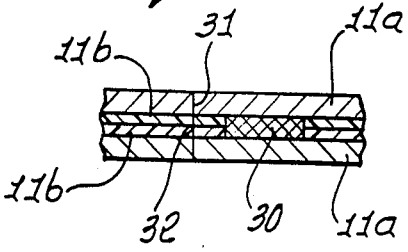
FIGS. 7 and 8 are sections showing modifications.

In FIG. 7, there are first and second paper sheets 11*a*, and first and second plastic films (for example polyethylene) 11*b* respectively integrally attached to the sheets 11*a*. The two films are locally heat bonded together in pocket edge configuration, as along three sides of a rectangular pocket. One such bonded area is shown at 30. The fourth side of the pocket is delineated as by a tear line 31, which may be perforations extending through the composite, as shown. The pocket entrance along its fourth side is located at 32, i.e. the intersection of the tear line and the non-bonded interface between the films 11*b*.

Figure 2:
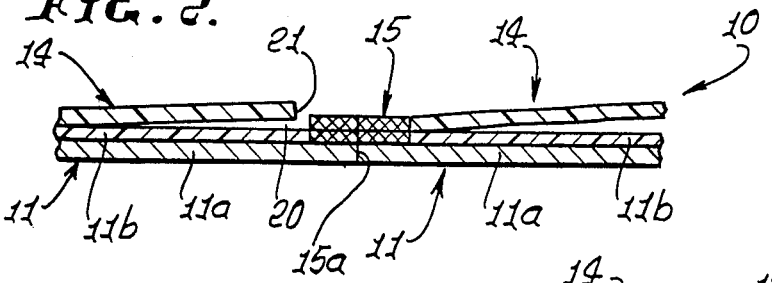
FIG. 2 is an enlarged section taken on lines 2—2 of FIG. 1.
Figure 8:
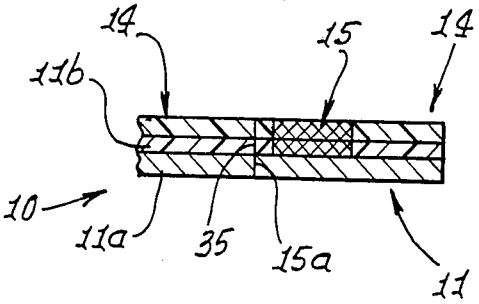

In FIG. 8, the construction is like that of FIG. 2, except that the tear line 15*a* is now offset from the bonded area 15. The tear line 15*a* thus extends along the fourth side of the pocket adapted to become opened when the bags or pockets are separated, to receive articles via the pocket mouth located at 35.

We claim:

1. In a packaging assembly adapted for labeling, the combination comprising:

(a) a computer printout sheet having through holes in two parallel rows, (b) a flexible plastic second sheet extending flatly adjacent one side of the printout sheet and locally bonded to the printout sheet along elongated bond zones extending at least partly about at least one pocket zone located between said two rows of holes, (c) said printout sheet including two removable edge strips in which said two rows of holes are formed, said second sheet also bonded to said removable edge strips, (d) there being two parallel tear lines defined by perforations via which the removable edge strips are attached to main extent of the printout sheet, the second sheet bonded to the printout sheet adjacent each tear line and at opposite sides thereof, multiple of said pocket zones being formed between said rows of holes, the second sheet having multiple free edges respectively associated with said pockets, the free edges being free of attachment to the printout sheet to provide access to the pocket's interiors between the free edges and the printout sheet, (e) said perforations extending through both the second sheet and printout sheet, whereby removal of said edge strips removes portions of said second sheet bonded to the printout sheet forming a clean edge, (f) said printout sheet comprising a paper sheet and a protective polyethylene film integrally attached to the paper sheet and exposed at one side thereof and the plastic second sheet consisting of polyethylene, and being heat bonded to said film at said bond zones, (g) the bond zones being formed as heat seals, the plastic second sheet heat sealed to the removable edge strips, said through holes also everywhere spaced from said perforations, (h) said paper sheet being between about #40 to #90 Kraft paper, (i) said plastic second sheet being transparent, and there being printed labeling on the printout sheet, (j) there being successive groups of pockets space longitudinally lengthwise along said sheets, in the direction of said rows of holes, and including additional perforated tear lines extending between successive longitudinally spaced pockets, the plastic second sheet bonded to the printout sheet along three sides of each pocket, each additional tear line extending laterally in longitudinally spaced relation to a pocket free edge which extends laterally along a fourth side of the pocket and via which an article is receivable into the pocket, (k) said bond zones formed as heat seals of the plastic sheet to the printout sheet, certain heat seals extending parallel to said rows of holes, and other heat seals extending generally perpendicular to said rows of holes.

* * * * *